US008046973B2

(12) United States Patent
Petrolati

(10) Patent No.: US 8,046,973 B2
(45) Date of Patent: Nov. 1, 2011

(54) MACHINE FOR PACKAGING MATTRESSES

(75) Inventor: Cesare Petrolati, Arcevia (IT)

(73) Assignee: Teknomac S.r.l., Serra de' Conti (Ancona) (IT)

( * ) Notice: Subject to any disclaimer, the term of this patent is extended or adjusted under 35 U.S.C. 154(b) by 292 days.

(21) Appl. No.: 12/446,427

(22) PCT Filed: Oct. 22, 2007

(86) PCT No.: PCT/EP2007/061300

§ 371 (c)(1),
(2), (4) Date: Apr. 20, 2009

(87) PCT Pub. No.: WO2008/049812

PCT Pub. Date: May 2, 2008

(65) Prior Publication Data

US 2010/0319301 A1 Dec. 23, 2010

(30) Foreign Application Priority Data

Oct. 23, 2006 (IT) ..... B02006A0728

(51) Int. Cl.
*B65B 59/00* (2006.01)
*B65B 63/04* (2006.01)
*B65B 11/04* (2006.01)

(52) U.S. Cl. ..... 53/118; 53/211; 100/5; 100/89

(58) Field of Classification Search ..... 53/116–118, 53/587, 203, 209–211, 214; 100/5, 89; *B65B 59/00, B65B 63/04, 11/04*

See application file for complete search history.

(56) References Cited

U.S. PATENT DOCUMENTS

| | | | | | |
|---|---|---|---|---|---|
| 378,570 | A * | 2/1888 | Brady et al. | ..... | 100/89 |
| 862,105 | A * | 7/1907 | Reagan | ..... | 100/89 |
| 900,205 | A * | 10/1908 | Reagan | ..... | 100/89 |
| 1,510,885 | A * | 10/1924 | Dunlap | ..... | 100/89 |
| 2,157,765 | A * | 5/1939 | Lanter | ..... | 53/118 |

(Continued)

FOREIGN PATENT DOCUMENTS

DE 19629606 A1 4/1997

(Continued)

OTHER PUBLICATIONS

International Search Report, for PCT/EP2007/061300, Mar. 14, 2008, 2 pages.

*Primary Examiner* — Stephen F Gerrity
(74) *Attorney, Agent, or Firm* — William J. Sapone; Coleman Sudol Sapone P.C.

(57) ABSTRACT

The machine (100) comprises a supply station (S1) destined to receive a mattress (M) to be conveyed to a rolling station (S2) comprising a plurality of rolling rollers (1), partly arranged in a fixed section (21) of the station (S2) and partly arranged in an openable section (22), arranged in respective curved lines to define internally thereof a practically-cylindrical rolling chamber (10) with horizontal axes. Sliding organs (3) are interposed between the fixed section (21) and the openable section (22), for regulating a mutual distance between the fixed section (21) and the openable section (22) in order to vary, within a predetermined range, a base area of the rolling chamber (10) and in order to determine corresponding rolling diameters of the mattress (M) comprised between a minimum value (D1) and a maximum value (D2).

18 Claims, 7 Drawing Sheets

U.S. PATENT DOCUMENTS

| | | | | | |
|---|---|---|---|---|---|
| 2,987,990 | A | * | 6/1961 | Mazza | 100/89 |
| 3,143,958 | A | * | 8/1964 | Sinclair | 100/89 |
| 3,342,014 | A | * | 9/1967 | Prager | 53/214 |
| 3,964,232 | A | | 6/1976 | Bender et al. | |
| 4,164,177 | A | * | 8/1979 | Canfield | 53/118 |
| 4,711,067 | A | * | 12/1987 | Magni | 53/116 |
| 5,259,171 | A | * | 11/1993 | Hannikainen | 53/211 |
| 5,784,856 | A | * | 7/1998 | Altvater et al. | 53/118 |
| 5,802,805 | A | * | 9/1998 | Oiestad | 53/118 |
| 5,934,041 | A | * | 8/1999 | Rudolf et al. | 53/118 |
| 6,098,371 | A | * | 8/2000 | Cassoli et al. | 53/201 |
| 2001/0013214 | A1 | * | 8/2001 | Viaud | 53/116 |

FOREIGN PATENT DOCUMENTS

| | | | | |
|---|---|---|---|---|
| FR | 2617122 | A1 | * | 12/1988 |
| IT | 1329172 | B1 | | 9/2005 |
| JP | 03133707 | A | * | 6/1991 |
| JP | 2002104312 | A | * | 4/2002 |

* cited by examiner

MACHINE FOR PACKAGING MATTRESSES

TECHNICAL FIELD

The invention relates to the technical sector of mattress packaging.

For mattresses made of a spongy material, for example latex, and not provided with springs, the prior art comprises a packaging process which includes spiral-rolling of the mattress and the stabilizing of the resulting configuration, for example by insertion thereof in a bag.

The rolling operation can be preceded by a stage of compressing the mattress in order to reduce the thickness thereof and therefore to reduce to the maximum diameter of the spiral-rolled mattress.

BACKGROUND ART

On Aug. 9, 2005, the present applicant obtained an Italian patent for industrial invention, no. 1,329,172, relating to a "Method and Apparatus for Packaging Mattresses".

The above-mentioned patent concerns mattresses already inserted in corresponding enveloping bags, which are supplied to a press with the open side of the bag facing upstream, and are there subjected to a compressing action which reduces the thickness thereof.

At the end of the compressing action, a welding bar is activated to stably join the flaps of the bag about the mattress, thus preventing the mattress from newly expanding after the press is re-opened.

The bag is advantageously of a size such that posteriorly of the welding there remains a length, or "tail" which is destined to receive, at the transversal end edge, a strip of adhesive tape, which at the end of the rolling process will stabilize the spiral configuration of the mattress.

The apparatus of the above-cited patent advantageously exhibits a spiral-rolling station which comprises two half-shells, of which one is fixed and the other is hinged thereto, such as to be able to open inferiorly in order to enable the completed package to be unloaded.

A first operating limit of the above technical solution relates to the fact that the apparatus can only roll mattresses inserted in bags, and the bags must be of a suitable length to enable stabilization, using adhesive tape, of the above-mentioned spiral-rolled configurations.

Further, the above-described apparatus is conformed such that the external diameter of the roll obtained is fixed, independently of the thickness of the mattress.

In other words, a smaller spiral cannot be obtained to reduce overall packaged size, when the thickness of the mattress would permit such a reduction, and vice versa.

SUMMARY OF THE INVENTION

The aim of the present invention is thus to provide a machine for packaging mattresses which is conformed such as to enable a variation in rolled-up diameter from a minimum to a maximum, to be defined according to the thickness thereof.

A further aim of the invention consists in providing a machine which can package mattresses independently of the fact that they are already packaged, or not, in a relative bag.

The above mention aims are obtained, in accordance with the contents of the claims, by a machine for packaging mattresses, of a type comprising a supply station destined to receive a horizontally-arranged mattress to be conveyed to a rolling station comprising a plurality of rolling rollers, partly arranged in a fixed section of the station and partly arranged in an openable section, arranged in respective curved lines to define internally thereof a practically-cylindrical rolling chamber, the machine being characterized in that it further comprises sliding organs, interposed between the fixed section and the openable section, for regulating a mutual distance between the fixed section and the openable section in order to vary, within a predetermined range, a base area of the rolling chamber and in order to determine corresponding rolling diameters of the mattress comprised between a minimum value and a maximum value.

BRIEF DESCRIPTION OF THE DRAWINGS

The characteristics of the invention will better emerge from the following description of a preferred embodiment of the machine of the invention, as claimed in the appended claims and with the aid of the accompanying figures of the drawings, in which:

BEST MODE FOR CARRYING OUT THE INVENTION

Figure 1:
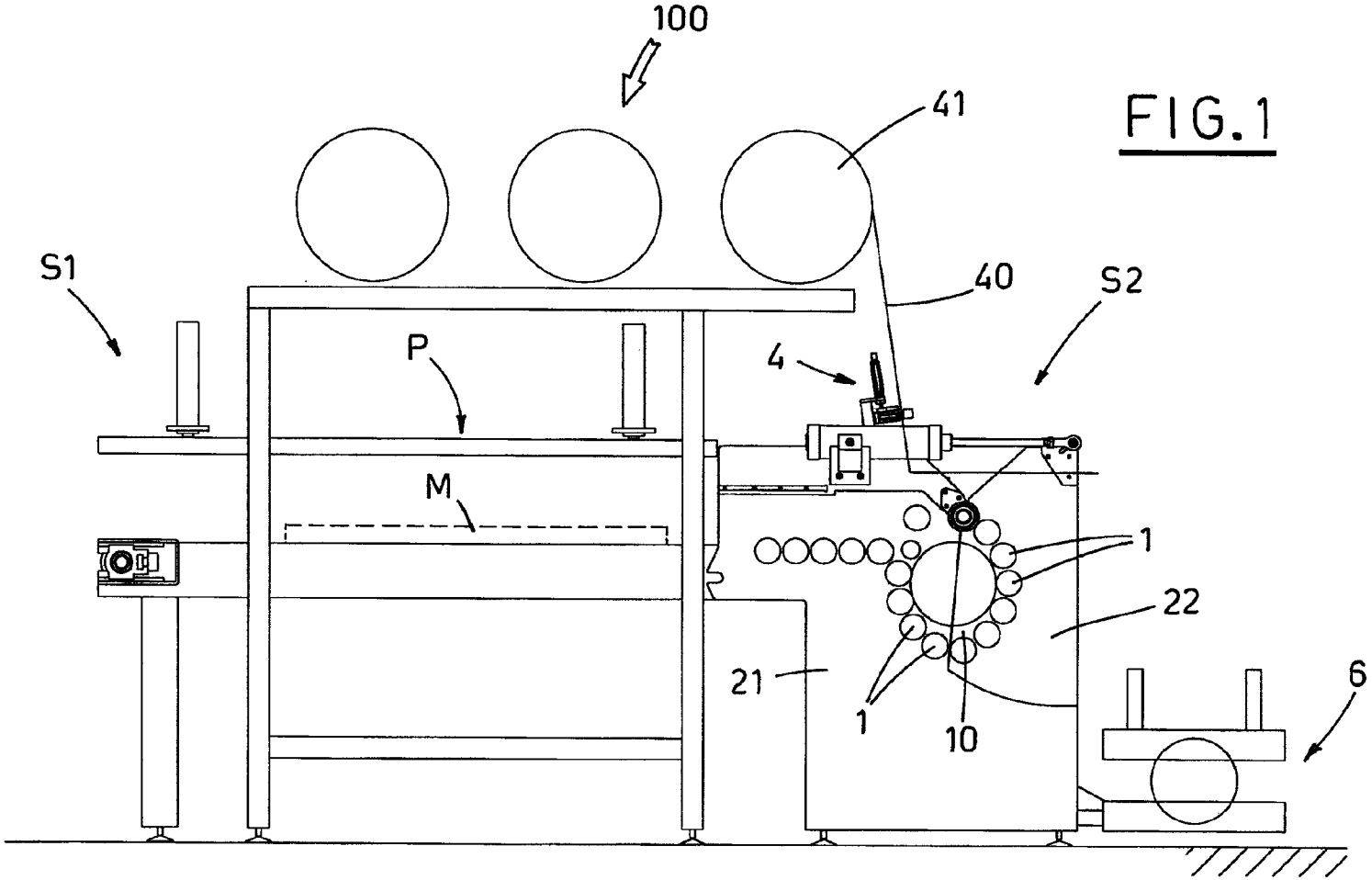
FIG. 1 is a lateral schematic view of the machine, with the rolling station predisposed for the minimum rolling diameter.

With reference to the above-mentioned figures of the drawings, 100 denotes in its entirety the packaging machine of the invention, comprising, in a known way, a supply station S1 destined to receive a horizontally-lying mattress M, to be conveyed to a rolling station S2, arranged downstream of the supply station S1, in which rolling station S2 the mattress M will be spiral-rolled in order to facilitate transport and stocking thereof.

In the illustrated machine 100, the supply station S1 is provided with known pressors P and welding means (the latter not illustrated) which are made operative only with already-bagged mattresses M (bag B), while for non-bagged mattresses M they are deactivated, as will be more fully explained herein below.

Alternatively, machines can be provided without the pressor organs and the welding means, if the machines are destined only to roll non-bagged mattresses M.

The rolling station S2 comprises a plurality of rolling rollers 1, arranged partly in a fixed section 21 of the station S2 and partially in an openable section 22, in respective curved lines, defining, internally thereof, a rolling chamber 10 having a practically cylindrical shape and a horizontal axis.

In the fixed section 21, means 25 are located upstream of the rolling chamber 10, for supporting the mattress when the mattress arrives in an extended configuration from the supply station S1, and for guiding the mattress towards the upper inlet 10A of the rolling chamber 10.

The means for supporting and guiding 25, in the embodiment of figures from 1 to 6, are constituted by a lower horizontal roller plane 26 and a deviator roller 27, located above the lower horizontal roller plane 26, close to the inlet 10A.

The deviator roller 27 intercepts the front end of the mattress M and directs it towards the inlet 10A.

In the invention, the machine 100 comprises sliding organs 3, interposed between the fixed and openable sections 21 and 22, which regulate the mutual distance between the fixed and openable sections 21 and 22 within a predetermined range, in order to change the base area of the rolling chamber 10.

The displacement between the fixed section 21 and the openable section 22 gives rise to slight variations in the profile of the base area of the rolling chamber 10, due to the fact that the radii of curvature, on which the fixed and openable sections 21, 22 are arranged, are obviously unchanged and the respective centres thereof can coincide only at a predetermined point of the permitted opening between the sections 21, 22.

Figure 5:
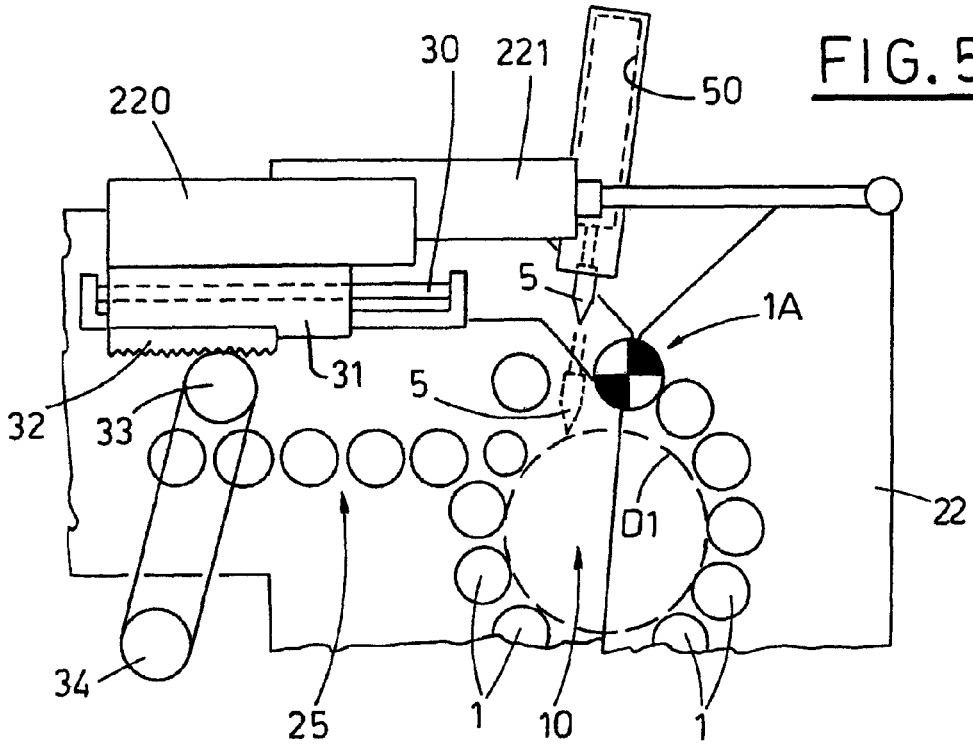
Figure 12:
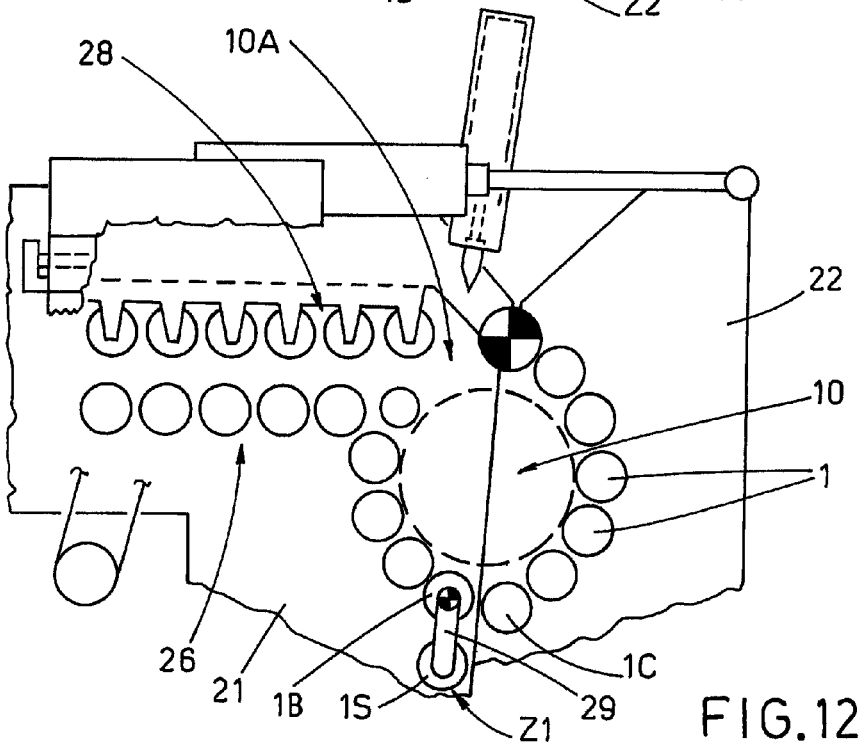

In the enclosed figures of the drawings, as a non-limiting embodiment, the profile is seen to be close to a circumference in proximity of the maximum distance position between the fixed section 21 and the openable section 22 (FIGS. 6, 13), while it is more oval in the minimum distance position (FIGS. 5, 12).

However, it is stressed that the above-described variations do not minimally influence the operability of the machine, as it is entirely obvious that the rolled mattress, once it has exited the rolling chamber 10, spontaneously finds the regular form to be assumed by elastic reaction.

The sliding organs 3 are constituted, for example, by horizontal stems 30 (of which only one is visible in FIGS. 5 and 6) symmetrically arranged and made integral to the sides of the fixed section 21, respective sleeves 31 being slidably coupled to the stems 30, the sleeves 31 being made integral to the bearing structure 220 of the openable section 22.

A horizontal rack 32 is fixed to at least one of the sleeves 31, which rack 32 is destined to enmesh with a pinion 33 associated to a motor 34, preferably electronically-controlled, for example of the brushless or step type.

The motor 34 is managed by a control unit, not illustrated; by means of a control panel (also not illustrated) connected to the control unit the operator can set the required measurement for the rolling diameter for the mattress M; there follows activation of the motor 34 in one direction or another to determine the translation of the openable section 22 with respect to the fixed section 21 between the positions corresponding to the minimum base area (FIGS. 1 and 5) and the maximum base area (FIGS. 2 and 6) of the rolling chamber 10.

A jack 221 is associated, in a known way, to the bearing structure 220 of the openable section 22, which jack 221 commands the rotation of the openable part 22 according to an axis X that coincides with the axis of a roller IA, for inferiorly opening the rolling chamber 10 at end of operations.

The machine 100 further comprises dispensing organs 4, associated to the rolling station S2, for supplying the rolling station S2, in phase relation with the rolling of the mattress M, with a film 40 of waterproof material unwinding from a reel 41 which will be wound about the mattress M in strict adherence thereto.

Figures 2, 3:
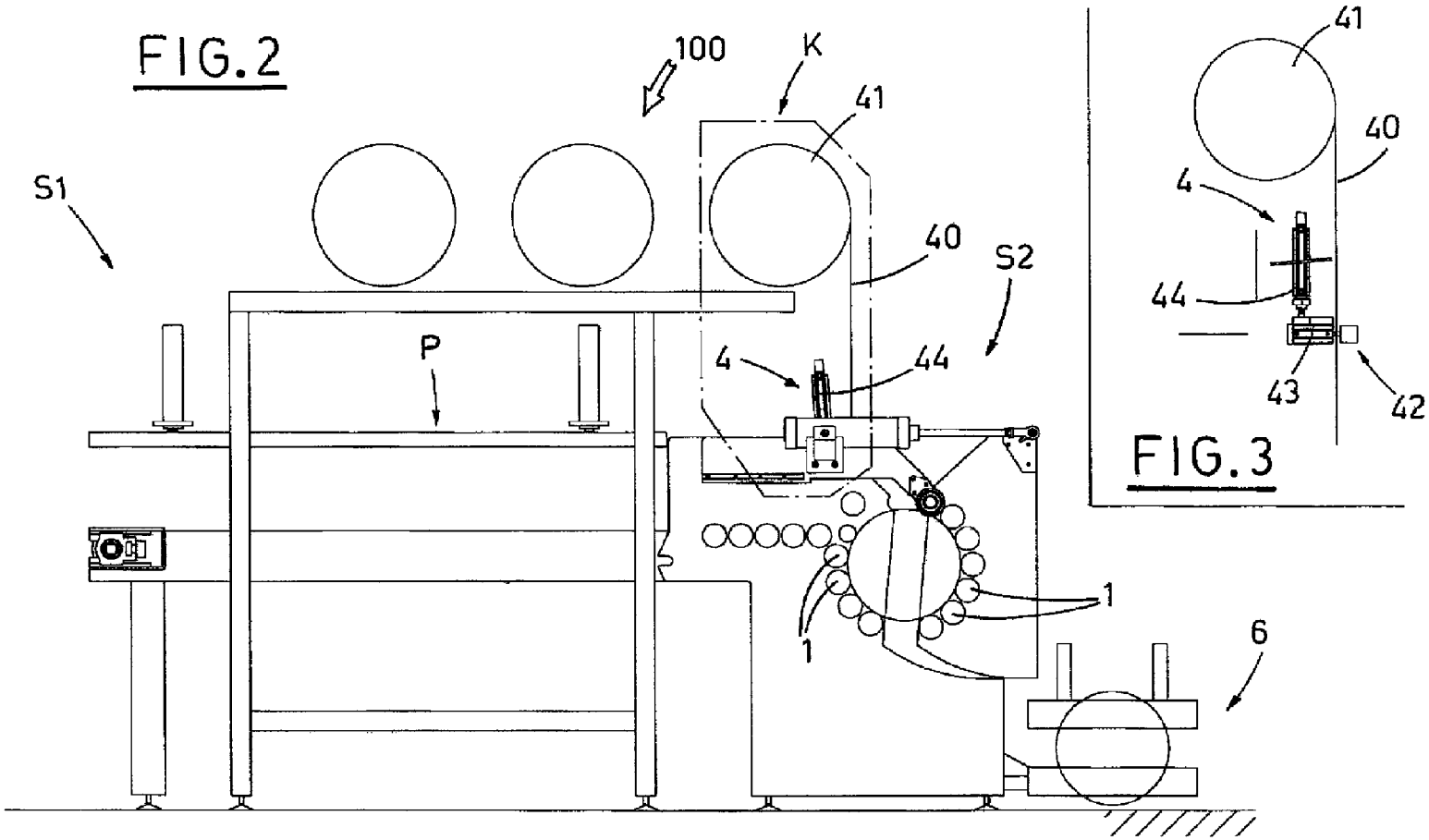
FIG. 2 illustrates, in the same view as in FIG. 1, the machine with the rolling station predisposed for the maximum rolling diameter.
FIG. 3 illustrates detail K of FIG. 2, with some parts removed better to evidence others.
Figure 4B:
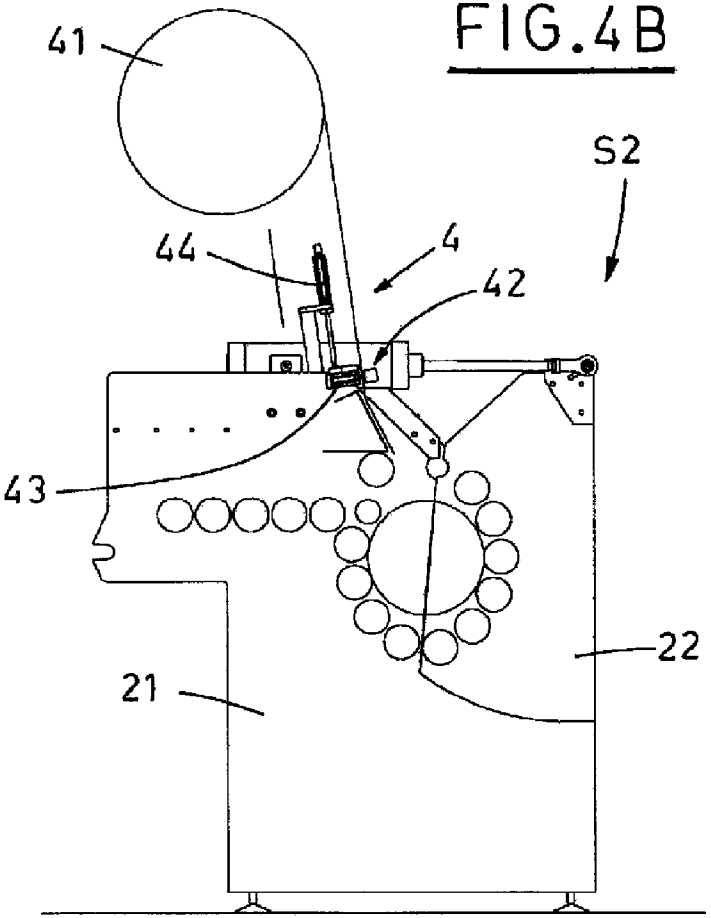
FIGS. 4A, 4B are lateral views of two operating stages of the organs of FIG. 3.
Figure 4A:
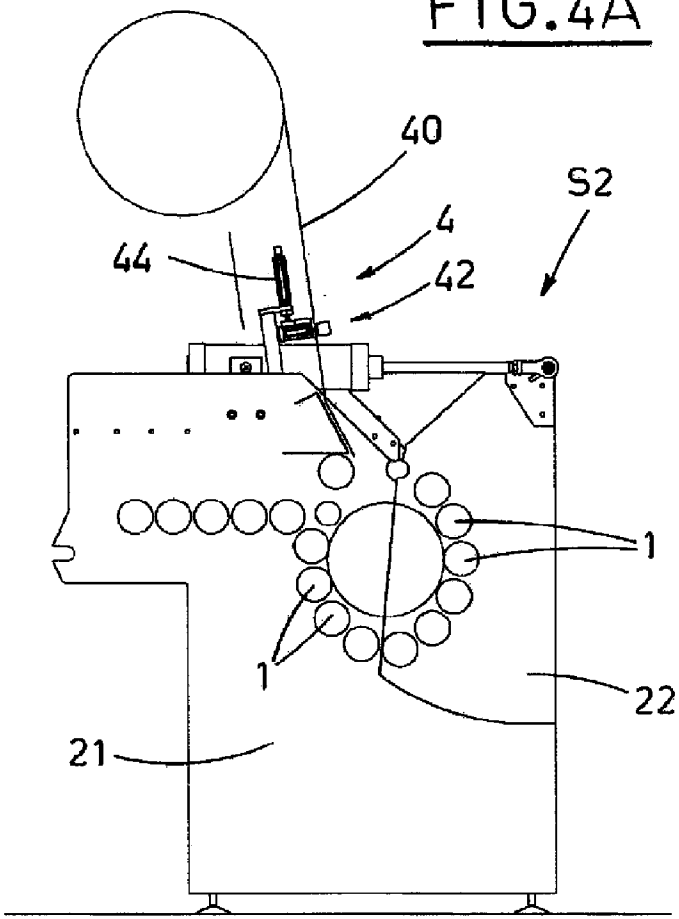

The reel 41 is supported in the upper part of the machine 100 and the film 40, which exhibits a greater width than the width of the mattress M, is unwound in a downwards direction and transits between the dispensing organs 4 constituted, for example, by transversal pliers 42, openable and closable by first jacks 43, respectively for allowing transit and holding the film 40, with the pliers 42 activated in a perpendicular direction to the opening and closing direction by second jacks 44 supported by the bearing structure 220 of the openable section 22 (FIGS. 3, 4A, 4B).

Figure 6:
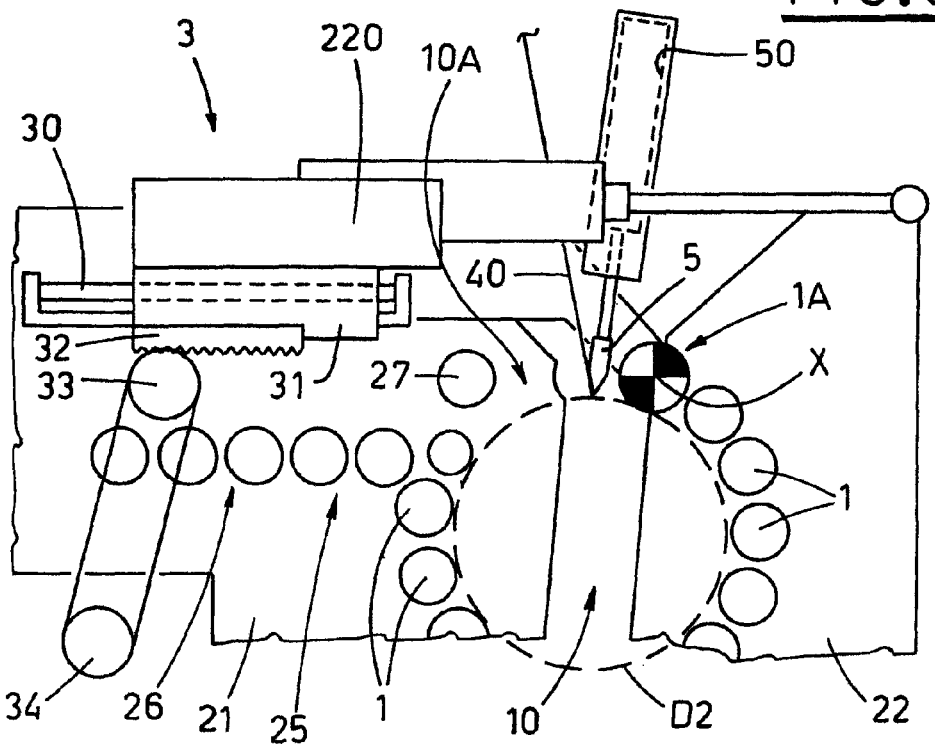
FIGS. 5, 6 are schematic lateral views in enlarges scale of the organs for adjusting the diameter in the rolling station, respectively in the maximum and minimum diameter configurations.

A welding bar 5 is provided internally of the rolling chamber 10, which welding bar 5 is mobile in a more-or-less vertical direction by action of relative actuators 50, also supported on the structure 220 (FIGS. 5 and 6).

The welding bar 5 acts transversally on the film 40 at the end of the winding operation, as will be more fully described herein below.

Finally, the machine 100 comprises welding means 6 located downstream of the rolling station S2, which act on the heads of the tubular package which has exited the rolling station S2 in order to close and seal the heads (FIGS. 1 and 2).

The functioning of the machine 100 will now be described; the machine 100 according to the present invention exhibits various similarities with the apparatus described in the patent belonging to the same applicant and mentioned in the premises to the present document.

Differently to the above-mentioned apparatus, the machine 100 can package, as already mentioned, mattresses M provided with a bag B or without the bag.

In a case where the mattress M is non-bagged, the pressor organs and the welding means in the supplying station S1 are deactivated; the rolling diameter to be obtained is regulated by setting the control panel which commands the motor 34 of the sliding organs 3.

The salient stages of the functioning cycle are schematically illustrated in figures from 7 to 8C, considering, purely by way of example, that as in this case the mattress cannot be pre-compressed, a large-size rolling chamber 10 is required for a maximum rolling diameter D2.

Figure 7:
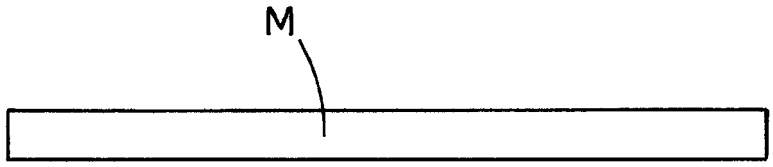
FIGS. 7, 8A, 8B, 8C schematically illustrate the stages of packaging of a mattress, in a first operating mode.
Figure 8A:
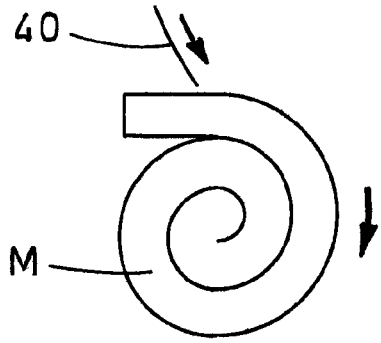

In FIG. 7, the mattress M, in a stretched configuration, is about to be introduced into the rolling chamber 10, in which it is to be spiral-wound, as illustrated in FIG. 8A.

The dispensing organs 4 are activated in phase-relation with the entrance of the terminal part of the mattress M into the chamber 10, with the closing of the transversal pliers 42 and the descent thereof (see also FIG. 4B) in order to introduce the film 40 into the rolling chamber 10, and to enable the film 40 to be inserted between the mattress M and the rollers 1.

Figure 8B:
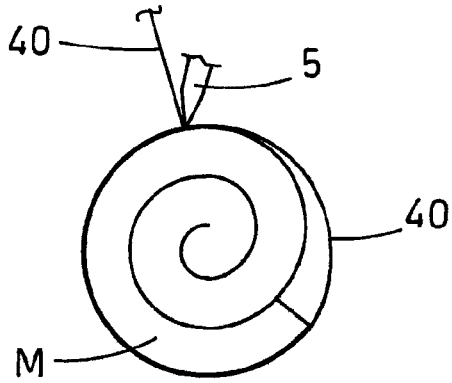

The pliers 42 are then opened and made to rise into the initial position (see also FIG. 4A), while the film 40 is unwound from the reel 41 and wound, for a predetermined number of revolutions of the reel 41, in strict adherence on the mattress M; at this point the welding bar 5 is activated to descend until it intercepts the tubular package thus realized, in order to cut the now-wound length of film 40 from the reel 41, and to join the posterior end of the cut length of film 40 to the underlying spires of the same film 40 (FIG. 8B).

Figure 8C:
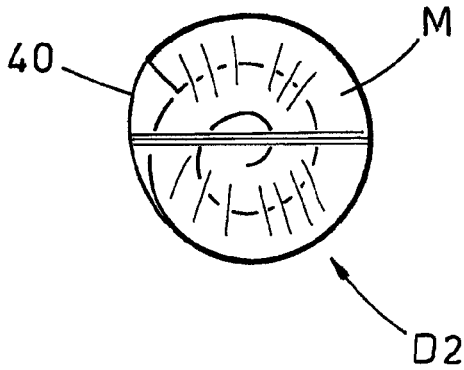

Then the jack 221 is activated to open the openable section 22, enabling the unloading of the tubular package, which package is then conveyed by force of gravity to the welding means 6 which act on the heads of the package to close and seal them (FIG. 8C).

For mattresses M with envelope-type covers B, the pressors organs P and the connected welding means are activated, then the rolling diameter is regulated which in this case, and purely by way of example, and with the mattress M precompressed, is considered to be the minimum rolling diameter D1.

Figure 9:
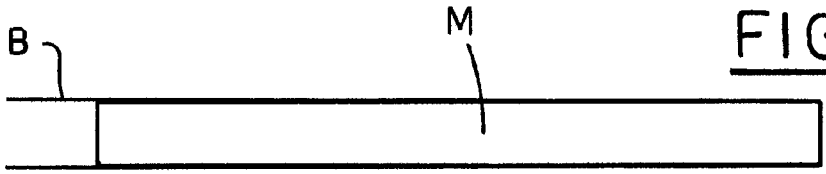
FIGS. 9, 10, 11A, 11B, 11C schematically illustrate the stages of packaging of a mattress, in a second operating mode.
Figure 10:
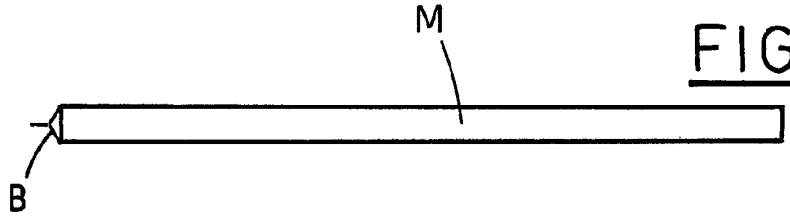

The mattresses M are introduced into the supply station S1 with the open side of the envelope B facing backwards (FIG. 9), and are vertically compressed by the pressor organs P in order to reduce the thickness thereof; the welding means 6 are activated in phase relation to stabilize the configuration with the closing of the open side (FIG. 10).

Figure 11A:
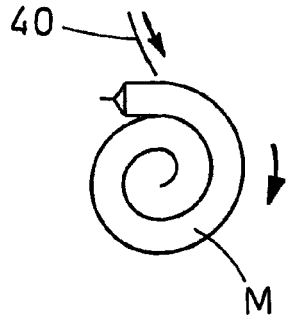
Figure 11B:
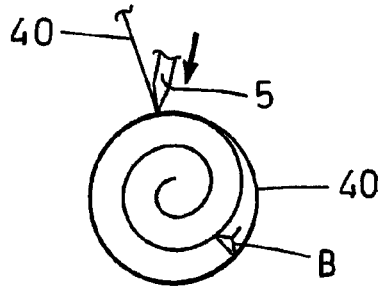
Figure 11C:
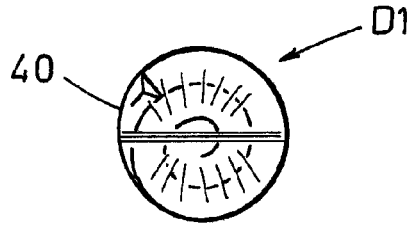

The successive stages, illustrated in FIGS. 11A, 11B, 11C, are the same as those previously described for the unpacked mattress, with reference to FIGS. 8A, 8B, 8C.

With an already-bagged mattress M, a package is obtained which offers a double protection and enables the final retailer to remove the film 40, so that the mattress can be extended, while leaving the mattress itself protected by the bag B.

Figure 13:
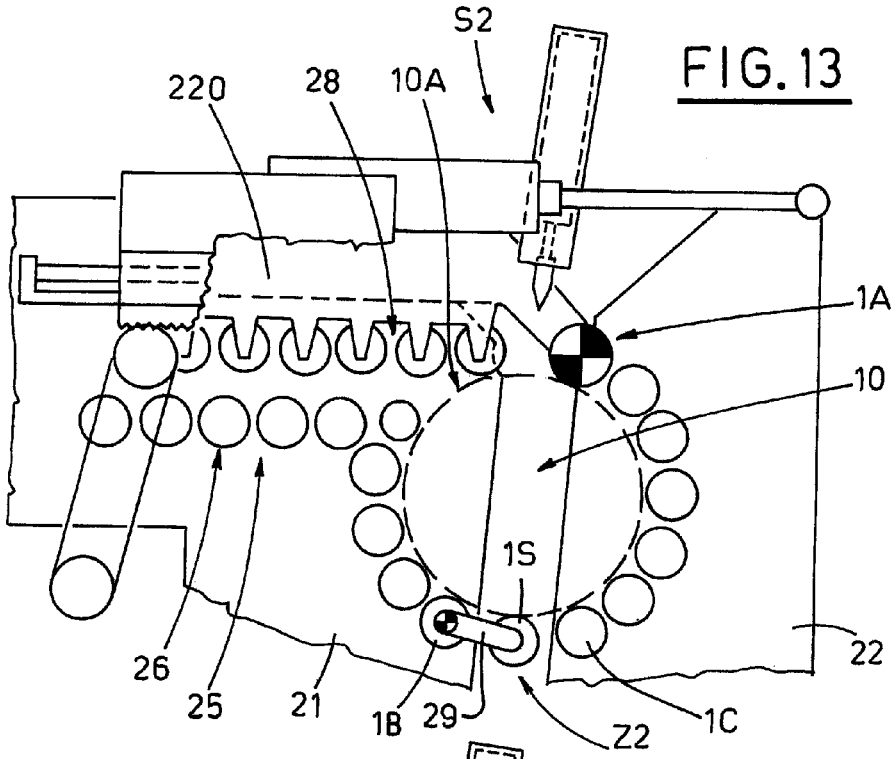
FIGS. 12 and 13 illustrate, in views which are similar to those of FIGS. 5 and 6, constructional variants of the rolling station.

In FIGS. 12, 13 two construction variants of the rolling station S2 are illustrated, which two variants are preferably used in combination, even though, from a functional point of view, they are independent of one another.

The first of the variants relates to the means 25 for supporting and guiding the mattress M towards the inlet 10A of the rolling chamber 10.

Apart from the lower horizontal roller, the means 25, in the variant, comprise a second upper horizontal roller 28, opposite the first, which is destined to contact the mattress M superiorly.

The horizontal upper roller 28 is included in place of the deviator roller 27 and optimizes the same functions as performed by the deviator roller 27.

To this end, the upper horizontal roller 28 is advantageously associated to the bearing structure 220 of the openable section 22, conformed for the purpose.

Consequently, the upper roller 28 follows the movements of the openable section 22 in the adjustments of the dimensions of the rolling chamber 10, maintaining the same position with respect to the pivot roller 1A of the rolling chamber 10; thus the roller 28 is always located ideally for directing the end of the mattress M towards the inlet 10A, whatever the size preset for the rolling chamber 10, and therefore independently of the variations in the dimensions of the inlet 10A which derive therefrom (see FIGS. 12 and 13).

The second of the variants relates to the low part of the rolling chamber 10, in the zone where the two adjacent rollers 1B, IC are neared to one another, respectively belonging one to the fixed section 21 and the other to the openable section 22.

Oscillating arms 29 (of which only one is visible) are hinged to the ends of one of the two rollers, for example the roller 1B of the fixed section 21; the oscillating arms 29 rotatably support a supplementary roller 1S.

The arms 29 are activated by an actuator, not illustrated, which determines for them and for the associated supplementary roller 15 two extreme positions Z1, Z2, one of which positions is a rest position, in which the supplementary roller 15 is external of the rollers 1B, 1C and another of which positions is a work position, in which the supplementary roller 15 is interposed between the rollers 1B, 1C.

The rest position Z1 is set in phase relation with the minimum dimensions of the rolling chamber 10, when the fixed section 21 and the openable section 22 are close or side-by-side (FIG. 12) and, consequently, the rollers 1B, 1C are sufficiently close to one another in order to guarantee continuity of the relative rolling diameter.

By increasing the dimensions of the rolling chamber 10, with a progressive distancing of the openable section 22 with respect to the fixed section 21, the two rollers 1B, 1C are distanced and a space is created between them, which interrupts the continuity of the rolling diameter and can cause catching and jagging of the front end of the mattress M in the initial stage of rolling.

When the space between the rollers 1B, 1C is sufficient, the supplementary roller 1S is arranged in the relative work position Z2, interposing between the two, such as to re-establish the continuity (FIG. 13) and ensure a regular rolling operation.

A further construction variant, not illustrated, relates to the location of the welding means 6, which instead of being downstream of the rolling station S2, as illustrated, can be placed at the same position thereas.

In this case, the means 6 comprise, at the sides of the rolling chamber 10, pressor organs which act in cooperation with nozzles for blowing hot air, for crushing and welding the film 40 to the heads of the tubular package obtained after the rolling stage.

With the above-described variant, a finished package is advantageously obtained internally of the rolling chamber 10, with obvious savings in terms of times and space occupied.

From the above the advantageous characteristics of the machine of the invention are evident. The invention enables adjustment of the rolling diameter of the mattress from a minimum to a maximum, to be defined according to the thickness of the mattress.

The versatility of the machine is further increased by the fact that mattresses can be packaged independently of whether they have been inserted or not in a bag.

The described machine, in the version comprising all of the variants, exhibits an optimal functioning in any operating condition, guaranteeing a high degree of reliability.

The technical solutions adopted to obtain the peculiarities described above are simple, reliable and with modest costs, such as not to significantly impact on the total costs for realizing the machine.

The above description is, however, intended as a non-limiting example, so any modifications to details, introduced for technical, functional or productive reasons, are considered to enter within the ambit of protection as defined by the following claims.

The invention claimed is:

1. A machine for packaging mattresses, comprising a supply station (S1) for receiving a horizontally-arranged mattress (M) to be conveyed to a rolling station (S2) comprising a plurality of rolling rollers (1), partly arranged in a fixed section (21) of the rolling station (S2) and partly arranged in an openable section (22), arranged in respective curved lines to define internally thereof a practically-cylindrical rolling chamber (10), the machine (100) having sliding organs (3), interposed between the fixed section (21) and the openable section (22), for regulating a mutual distance between the fixed section (21) and the openable section (22) in order to vary, within a predetermined range, a base area of the rolling chamber (10) and in order to determine corresponding rolling diameters of the mattress (M) comprised between a minimum value (D1) and a maximum value (D2).

2. The machine of claim 1, characterized in that the slidable organs (3) are constituted by horizontal stems (30), arranged symmetrically and made integral to sides of the fixed section (21), respective sleeves (31) being slidably coupled to the stems (30), which sleeves (31) are made integral to a bearing structure (220) of the openable section (22), a horizontal rack (32) being constrained to at least one of the sleeves (31), which horizontal rack (32) enmeshes with a pinion (33) associated to an electronically-controlled motor (34), which motor (34) is commanded by a control unit for impressing a translation on the openable section (22) with respect to the fixed section (21), in one direction or in another direction.

3. The machine of claim 1, further comprising: dispensing organs (4) associated to the rolling station (S2), which dispensing organs (4) supply a film (40) to the rolling station (S2) in a phase relation with a rolling of the mattress (M), the film (40) being unwound from a reel (41) and adherently enveloping the mattress (M); a welding bar (5) provided in the rolling chamber (10) for acting on the film (40) at a conclusion of the winding operation, in order to cut a length of the film (40) wound about the mattress (M) off the reel (41), and to join a posterior flap of the cut length of film (40) to underlying rolled spires of the film (40), so as to define a tubular package; the welding means (6) acting on heads of the tubular package, in order to close and seal the heads.

4. The machine of claim 3, characterized in that the dispensing organs (4) are constituted by transversal pliers (42) which are openable and closable by first jacks (43), respectively to allow transit and to stop transit of the film (40), the pliers (42) being movable perpendicularly to directions of opening and closing thereof by second jacks (44) supported on a bearing structure (220) of the openable section (22).

5. The machine of claim 4, characterized in that the film (40) is made of waterproof material.

6. The machine of claim 3, characterized in that the welding means (6) are located at sides of the rolling chamber (10) and act in phase relation with an end of the winding, welding and film-cutting operations.

7. The machine of claim 6, characterized in that the welding means (6) are constituted by nozzles for blowing hot air.

8. The machine of claim 3, characterized in that the film (40) is made of waterproof material.

9. The machine of claim 1, further comprising means (25) for supporting the mattress (M), which mattress (M) arrives in an extended configuration from the supply station (S1), and for guiding the mattress (M) towards an upper inlet (10A) of the rolling chamber (10).

10. The machine of claim 9, characterized in that the supporting means (25) are associated to the fixed section (21) of the rolling station (S2) and comprise a lower horizontal roller plane (26), on which the mattress (M) is rested, and a deviator roller (27), located above the roller plane (26) near the upper inlet (10A), for intercepting a front end of the mattress (M) in order to direct the front end towards the upper inlet (10A).

11. The machine of claim 9, characterized in that the supporting means (25) comprise a lower horizontal roller plane (26), associated to the fixed section (21) of the rolling station (S2), for restingly receiving the mattress (M), and an upper horizontal roller plane (28), opposite the lower horizontal roller plane (26), associated to the openable section (22) of the station (S2), for contacting an upper portion of the mattress (M) and directing a front end thereof towards the upper inlet (10A).

12. The machine of claim 1, further comprising a supplementary roller (1S) supported by oscillating arms (29) activated by an actuator, which actuator determines a rest position (Z1) and a work position (Z2) of the supplementary roller (1S), in which rest and work positions (Z1, Z2) the supplementary roller (1S) is respectively external of and interposed between two adjacent rollers (1B,1C) positioned in a lower part of the rolling chamber (10) and belonging respectively to the fixed section (21) and the openable section (22), the rest position (Z1) being set in phase relation with an adjustment to minimum values of the rolling diameter, in which the fixed section (21) and the openable section (22) are near to one another or side-by-side, and the work position (Z2) being set in phase relation with an adjustment to maximum values of the rolling diameter, in which the fixed section (21) and the openable section (22) and consequently the relative adjacent rollers (1B,1C) are reciprocally distanced.

13. The machine of claim 12, characterized in that the arms (29) are hinged at ends of one of the two adjacent rollers of the fixed section (21).

14. A machine for packaging mattresses, comprising a supply station (S1) provided with pressor organs (P) and welding means, for receiving a horizontally-arranged mattress (M) inserted in a bag (B) exhibiting an open end, which mattress (M) is compressed between the pressor organs (P) in order for a thickness of the mattress to be reduced, the mattress being stabilized in the compressed configuration by closing the open end of the bag (B), the closing being performed by the welding means, with the mattress (M) thus predisposed being conveyed to a rolling station (S2) in which a plurality of rolling rollers (1) are located, arranged partly in a fixed section (21) of the rolling station (S2) and partly in an openable section (22) in respective curved lines to define internally thereof a practically-cylindrical rolling chamber (10) having a horizontal axis, the machine (100) having sliding organs (3), interposed between the fixed section (21) and the openable section (22), for regulating a mutual distance between the fixed section (21) and the openable section (22) in order to vary, within a predetermined range, a base area of the rolling chamber (10) and in order to determine corresponding rolling diameters of the bagged mattress (M) comprised between a minimum value (D1) and a maximum value (D2).

15. The machine of claim 14, characterized in that the slidable organs (3) are constituted by horizontal stems (30), arranged symmetrically and made integral to sides of the fixed section (21), respective sleeves (31) being slidably coupled to the stems (30), which sleeves (31) are made integral to a bearing structure (220) of the openable section (22), a horizontal rack (32) being constrained to at least one of the sleeves (31), which horizontal rack (32) enmesh enmeshes with a pinion (33) associated to an electronically-controlled motor (34), which motor (34) is commanded by a control unit for impressing a translation on the openable section (22) with respect to the fixed section (21), in one direction or in another direction.

16. The machine of claim 14, further comprising: dispensing organs (4) associated to the rolling station (S2), which dispensing organs (4) supply a film (40) to the rolling station (S2) in a phase relation with a rolling of the bagged mattress (M), the film (40) being unwound from a reel (41) and adherently enveloping the bagged mattress (M); a welding bar (5) provided in the rolling chamber (10) for acting on the film (40) at a conclusion of the winding operation, in order to cut a length of the film (40) wound about the bagged mattress (M) off the reel (41), and to join a posterior flap of the cut length of film (40) to underlying rolled spires of the film (40), so as to define a tubular package; the welding means (6) acting on heads of the tubular package, in order to close and seal the heads.

17. The machine of claim 14, further comprising means (25) for supporting the mattress (M), which mattress (M) arrives in a bag in an extended configuration from the supply station (S1), and for guiding the bagged mattress (M) towards the towards an upper inlet (10A) of the rolling chamber (10).

18. The machine of claim 14, further comprising a supplementary roller (1S) supported by oscillating arms (29) activated by an actuator, which actuator determines a rest position (Z1) and a work position (Z2) of the supplementary roller (1S), in which rest and work positions (Z1, Z2) the supplementary roller (1S) is respectively external of and interposed between two adjacent rollers (1B,1C) positioned in a lower part of the rolling chamber (10) and belonging respectively to the fixed section (21) and the openable section (22), the rest position (Z1) being set in phase relation with an adjustment to minimum values of the rolling diameter, in which the fixed section (21) and the openable section (22) are near to one another or side-by-side, and the work position (Z2) being set in phase relation with an adjustment to maximum values of the rolling diameter, in which the fixed section (21) and the openable section (22) and consequently the relative adjacent rollers (1B, 1C) are reciprocally distanced.

* * * * *